US006305883B1

(12) United States Patent
Ozaki

(10) Patent No.: US 6,305,883 B1
(45) Date of Patent: Oct. 23, 2001

(54) CAGE FRAME FOR SHORE PROTECTION

(76) Inventor: Tetsuya Ozaki, 15-67 Sebato-cho Hofu-shi, Yamaguchi-ken 747-0031 (JP)

( * ) Notice: Subject to any disclaimer, the term of this patent is extended or adjusted under 35 U.S.C. 154(b) by 0 days.

(21) Appl. No.: 09/378,098

(22) Filed: Aug. 20, 1999

(30) Foreign Application Priority Data

Aug. 25, 1998 (JP) ..... 10-255978

(51) Int. Cl.[7] ..... E02D 29/00

(52) U.S. Cl. ..... 405/284; 405/273; 405/258; 405/15

(58) Field of Search ..... 405/258, 15, 16, 405/17, 19, 35, 284, 272

(56) References Cited

U.S. PATENT DOCUMENTS 4,655,637 * 4/1987 Vignocchi ..... 405/17
5,076,735 * 12/1991 Hilfiker ..... 405/284
5,472,297 * 12/1995 Heselden ..... 405/258
5,582,492 * 12/1996 Doyle, Jr. ..... 405/258
5,636,938 * 6/1997 Ragazzo ..... 405/15
6,120,215 * 9/2000 Osaki ..... 405/284

FOREIGN PATENT DOCUMENTS

126823 * 7/1984 (JP) ..... 405/258
116115 * 5/1989 (JP) ..... 405/258
402190519 * 7/1990 (JP) ..... 405/15
403257219 * 11/1991 (JP) ..... 405/258

* cited by examiner

*Primary Examiner*—William Neuder
*Assistant Examiner*—Frederick L. Lagman

(57) ABSTRACT

A cage frame for shore protection and so on with improves durability, the construction/execution on site can be easily performed, can easily create the best environment for organism to live and can be effectively used as a gathering place for fish. The hollow framing is formed by joining many plane frames with many openings on each and then filled with stones and/or broken stones. Each plane frame is formed by cast iron with joint structures integrally formed therewith. The joint structures are joined together to form the hollow framing on site.

14 Claims, 17 Drawing Sheets

CAGE FRAME FOR SHORE PROTECTION

FIELD OF THE INVENTION

This invention is related to earth stabilization, and more particularly to a cage frame which is suitable to be used for shore protection, side-slope protection, erosion control, hillside soil guards, landslide reconstruction, pier protection, foot protection, and to form soil guards for sand banks and the like by filling with stones or broken stones.

BACKGROUND OF THE INVENTION

In the prior art, shore protection works attempted to prevent erosion of the end of the slope and foundation movement by waves by covering the front of the slope with npraps and concrete blocks. Likewise, foot protection of the end of the slope was included to prevent the progress of foundation movement or erosion. For foot protection, many methods of constructions are used, for instance, the form shown in the Japanese patent applications 04359388 and 06164640 may be used. Hollow framing is typically formed by using wire netting and the cage frame is filled with stones, and/or broken stones, on the inside.

However, cage frames made by wire netting have several disadvantages. First, because the hollow framing is made by wire netting, it does not have sufficient strength. When the broken stones are added for filling, the wire netting is typically deformed by being not able to handle the weight of those, and it has a chance to be deformed by the force of water, such as during flooding. At these situations, the framing can not properly function as a cage frame for shore protection and the like because the broken stones would flow out. Second, because the wire netting is made with mild steel which has low carbon, it is easy to corrode. When part of wire netting is broken by slow deterioration, the cage frame function is defeated when the broken stones, stones and so on flow out from the broken part. Further, because the hollow framing is made by wire netting, bacteria which like carbon do not stick to the surface, so it cannot be used efficiently as a gathering place for fish.

Third, the hollow framing is constructed by joining many face materials, and for the joint, the string type material is used, the string type material is easily corroded and has a chance to be broken. If the string material is broken, the hollow framing will be apart, broken stones and stones will flow outside, then it can not properly function as the cage frame.

The purpose of this invention is because of these situations and to provide the cage frame for shore protection and so on which can have greatly improved durability, can be easily set up and executed at the site, can easily create appropriate environment for organism's habitat, and can be used efficiently as a gathering place for fish.

SUMMARY OF THE INVENTION

In one embodiment, the present invention cage frame forms the hollow framing by joining many planar frame members, sometimes referred to herein as "plane frames", with many openings on each. Thereafter, the broken stones and the like are used to fill the spaces inside the frame. Each plane frame is formed by cast iron with joints founded to each main framing, and the hollow framing is formed by joining the joints together with the joint parts. For the joint parts, the cylinder shape and the plate shape which have the same section for the total length, or the tapering shape wedge can be used.

These cage frames for shore protection and so on can be placed at appropriate places for shore protection, side-slide protection, a hillside sand guard, landslide reconstruction, and so on. Preferably, the plane frame is 40–80 cm (height)× 100–150 cm (length), weighs 10–30 kg, and is made entirely of cast iron.

When the plane frame is formed by cast iron, the strength of the cage frame is very improved. Therefore, the frame will not be deformed by receiving big force of water from flood and so on, or by being filled with broken stones, stones and so on, and can certainly prevent broken stones and stones from flowing out. Further, by using the plane frame which is 40–80 mm (height)×100–150 mm (length), weighs 10–30 kg and is made of cast iron, the plane frame can be handled more easily on site. In addition, because the joints of plane frames are jointed together with the joint parts, it is easy to form the hollow framing just by inserting plane frames, and because it is possible to join them in tight condition, the hollow framing can keep enough constructional strength.

Because each plane frame is made from cast iron, the joint which has the best shape which can improve the joint strength with the joint parts and the main framing can be easily joined as one. From this side, the strength of joining plane frames together can be improved. Because each plane frame is made of cast iron, when it is placed for shore protection and so on, the surface of plane frame provides iron, calcareous and magnesium, and creates nutritious water (mineral water) which is effective for organism growth. Attached bacteria promote water quality purification and propagation of alga, with that, the most appropriate environment for habitat of many types of organism including plants and fish, what is called the biotope, can be easily created.

Because each plane frame is made of cast iron with high quantity of carbon, the corrosion protective covering is created by reaction between carbon and other contained metal constituents, and it is resistant to seasons. It has enough corrosion resistance even under the water, and can be used for a long time.

Because each plane frame is made of cast iron, the same shape type of plane frame can be mass-produced by one cast type, and the unit price of plane frame can be decreased. Furthermore, for cast iron, besides iron, calcareous, magnesium and so on which are necessary elements for photosynthesis are mixed in as natural forms by liquefying. It is better to use the cast iron which is produced in a cupola and from the view point of improving the mechanical strength of panel frame, it is better to use ductile cast iron (FCD), moreover, austentite tempered ductile cast iron (ADI).

The above cage frame for shore protection and so on can be constructed by the following. By using the wedge-shaped part as the joint part, the joints can be joined tightly together by the joint part. Therefore the joint strength of panel frames can be improved. The joint part can be made of cast iron as the plane frame. Because the joint part is also made of cast iron, it can prevent corrosion by electric reaction, and bacteria which like carbon attach on the surface of wedge part, from this side, biotope can be easily created.

The same shaped joints are set on many plane frames as one, the different shaped joint parts can be used depending on the joining conditions of both joints. Therefore, most appropriate cage frames for shore protection and so on can be executed following the shape of the shore of river or ocean which is to be protected.

The joint has the central extending area (central tine) which is parted in the middle and has the pointy contacting face with the fixed degree, the right and left expanding parts (outer tines) which are set on the both sides of said central expanding area spacing equally, have the tilt contacting face on the outside of the point, and these base areas are attached to the base area of said central expanding area as one, and the pair of step forming panels (embossments) which is set on both sides of said central expanding area and forms the hook-shaped joint parts like this, the plane frames can easily be joined together straight, angled or crosswise and also joined vertically.

The perimeter of each plane frame is formed by the rectangle frame constructed with top and bottom frame members and right and left frame members, and with the vertical and horizontal cross pieces constructed within the generally rectangle frame. By doing so, it is easy to fill broken stones, stones and so on in the hollow framing, water can easily flow into the hollow framing, making it easy for bacteria to attach to the surface of the plane frame, promoting the purification of water quality and fertilizing the soil around the edge of water from this side, and the biotope can be created.

The plane frame can be used to form the side frame of the tubed hollow framing and also be used to form the side, bottom and top frames of the boxed hollow framing. For this situation, the opening set to each plane frame can be, besides the lattice style, the style forming diaper space, the zigzag style, or the style meandering circular motion. And for the tubed hollow framing, it includes the rectangular tube type, the square tube type, the partial circular tube type, and other strange shaped tube types.

The size of the opening of each plane frame is preferred to be 5–35 cm to prevent broken stones from flowing out depending on the size of broken stones even when 15–50 cm broken stones are used.

When broken stones, stones and so on are filled in the hollow framing, it is better to fill them as the gap between stones is created. By doing so, water can easily flow in the hollow framing, making it easy for bacteria to attach to the surface of the plane frame, purifying the water quality, fertilizing the soil around the edge of water and promoting the plants' habitat. From this side, the biotope can be created.

DETAILED DESCRIPTION OF THE INVENTION

Figure 1:
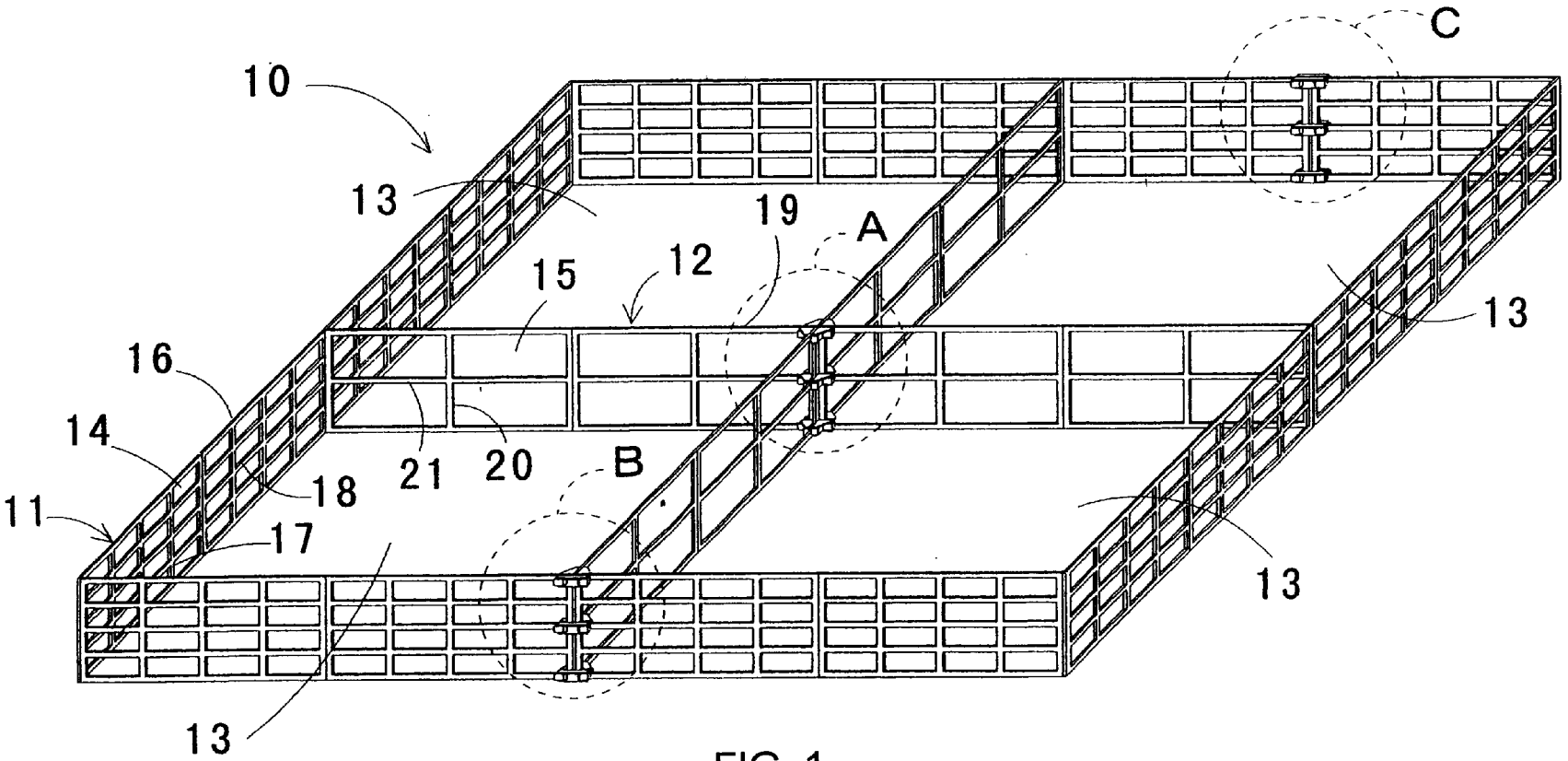
FIG. 1 is a perspective view of one embodiment of the cage frame of the present invention.

Referring to the Figures, the construction of the cage frame 10 for shore protection and so on is explained. As FIG. 1 shows, the cage frame 10 forms the hollow framing by joining two types of plane frames 11 and 12 and is constructed by filling the four filling spaces 13 which are formed within the hollow framing with broken stones and so on. The plane frame 11 which is used for framing the surrounding wall of the cage frame 10 has small openings 14 to prevent broken stones, stones and so on from falling out. The plane frame 12 which is used for framing the partition wall of the cage frame 10 has big openings 15.

As FIG. 1 shows, the plane frame 11 is constructed by building length (horizontal) and breadth (vertical) cross piece materials 17 and 18 on the main frame 16 which is itself constructed with rectangle perimeter frame formed by top and bottom frame elements, and the spaces between the length and breadth cross piece materials 17 and 18 form the openings 14. While the plane frame 12 is constructed by building length and breadth cross piece materials 20 and 21 on the main frame 19 formed by the rectangle frame, and the spaces between length and breadth cross piece materials 20 and 21 form the openings 15.

Figure 2:
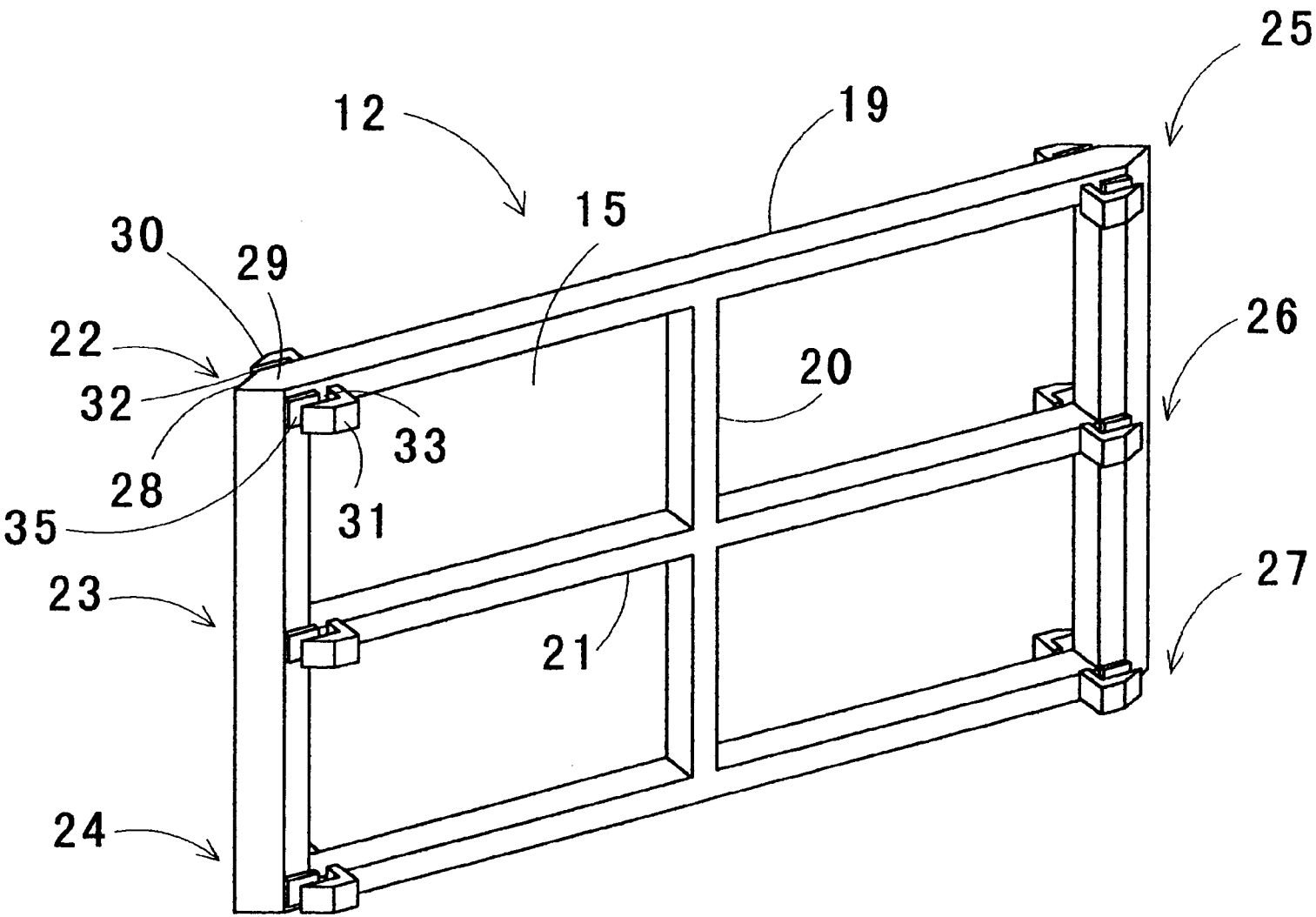
FIG. 2 is a perspective view of one frame member as shown in FIG. 1.
Figure 3:
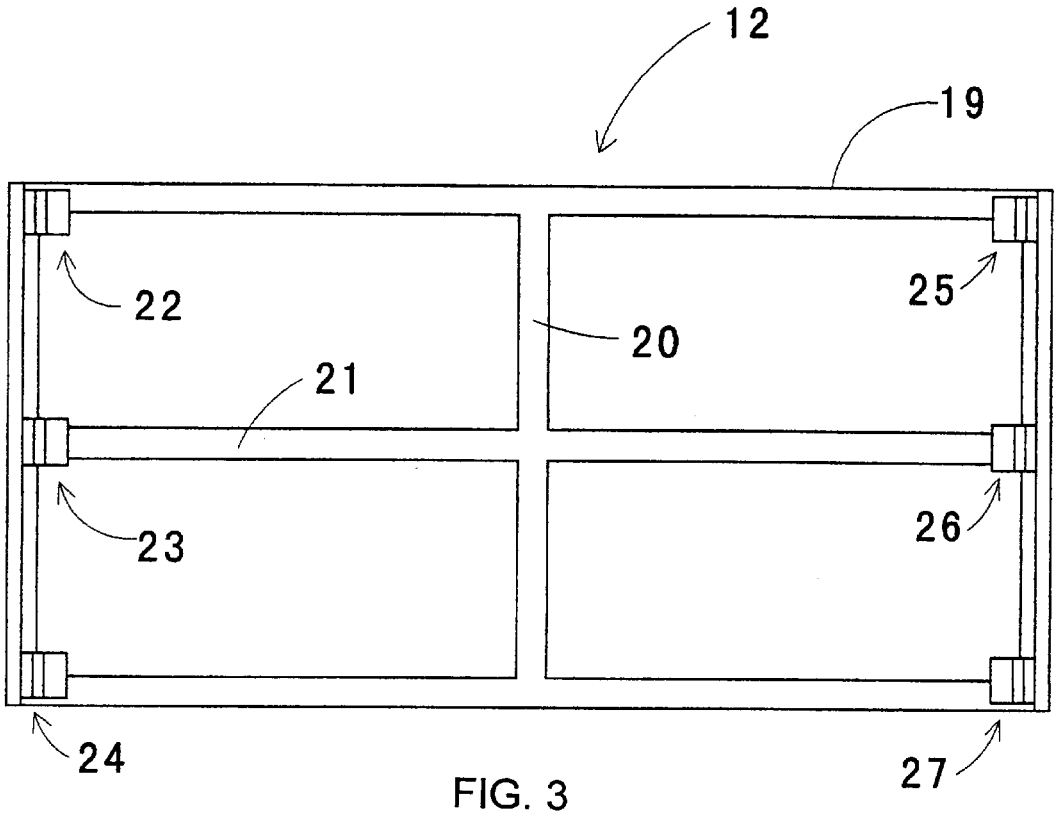
FIG. 3 is a front view of the frame member of FIG. 2.
Figure 4:
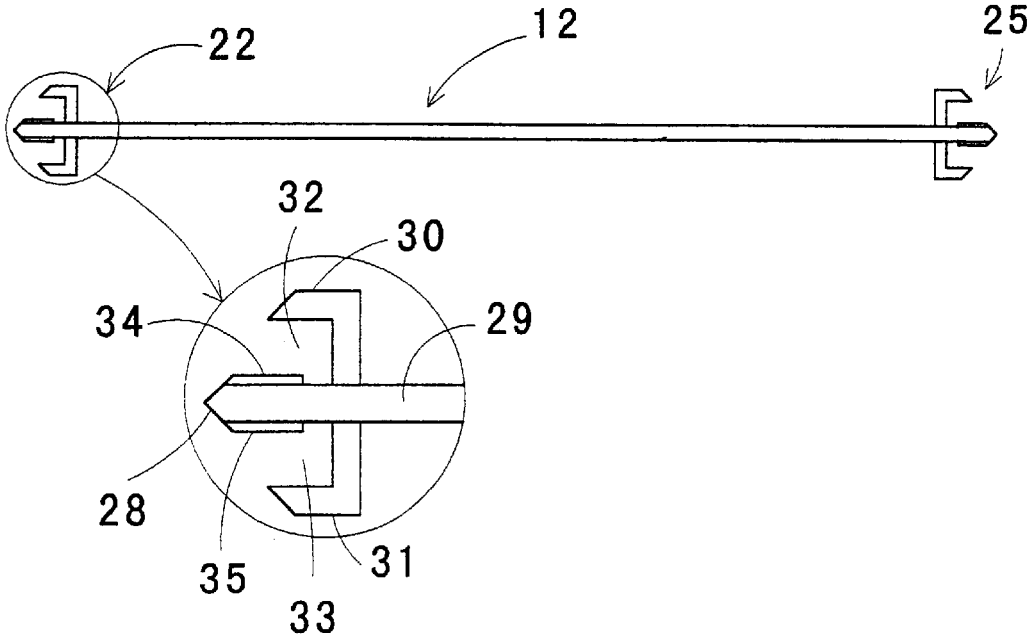
FIG. 4 is a top view of the frame member of FIG. 3.

Next, referring to FIGS. 2~4, the construction of the plane frame 12 is explained. As the Figures show, each upper, middle and lower part of both ends of the plane frame 12 has integrally formed therewith a joint, referred to with reference numbers 22–27 respectively. Likewise, each upper, middle and lower part of both sides of the plane frame 11 also has integrally formed joints 22–27. Each joint 22–27 has a central extending area which is parted in the middle and, for example, has the pointy contacting face 28 with 45° angle, the right and left expanding parts 30 and 31 which are set on the both side of central expanding area 29, have the 45° angle contacting face on the outside of the point, and these base areas are attached to the base area of said central expanding are 29 as one, and has the pair of step forming panels 34 and 35 which is set on the both sides of said central expanding area 29 and forms the hook-shaped wedged parts inserting space 32 and 33 as an example of the joint part inserting space by working with right and left expanding parts 30 and 31. For this implementation example, the plane frames 11 and 12, including the above joints 22~27, are made of cast iron, for instance produced using a cupola.

The plane frames 12 or the plane frame 11 and the plane frame 12 are strongly joined together using the joint 22~27 and cast iron wedge-shaped parts 36,44,45,46,51 and 52. Examples of the joints formed are shown in FIGS. 5–9 As shown, the configuration of the wedge-shaped parts 36,44, 45,46,51 and 52 are different depending on the joint condition of joints 22~27.

Figure 5:
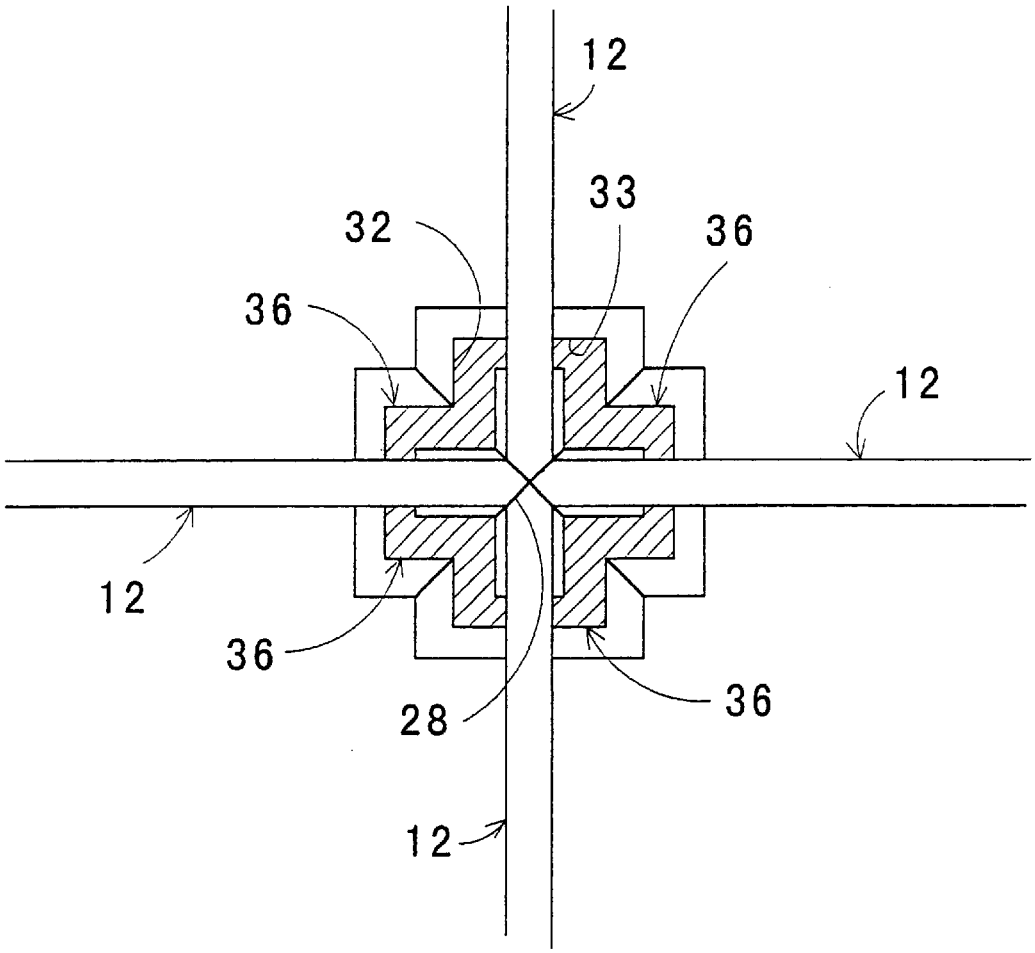
FIG. 5 is a top view of a four way joint between frame members (joint A of FIG. 1).
Figure 6:
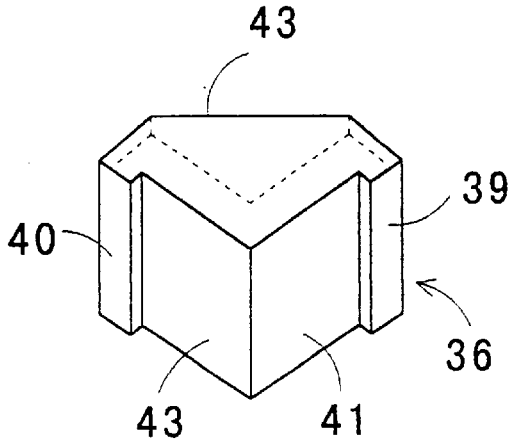
FIG. 6 is a perspective view of a wedge shaped part used in the joint of FIG. 5.

As FIG. 1 (the circled area A) and FIGS. 5 and 6 show, when four plane frames 12 are joined crosswise, four wedge-shaped parts 36 are used. FIG. 6 shows an example of the wedge-shaped part 36. The wedge-shaped part 36 is joined at a right angle from the plane level view and include the pair of hook-shaped locks 41 and 42 which have the catches 39 and 40 on the end and the falling prevention lid 43 which is connected to the upper end as one. Furthermore, the hook-shaped locks 41 and 42 are tapering shapes and narrowed downwards. By driving four wedge-shaped parts 36 into the eight corresponding hook-shaped wedged parts inserting spaces 32 and 33, four plane frames 12 can be easily joined very tightly. At this time, because four pointy contacting faces 28 are contacted together and also thrusted, four plane frames 12 are strongly joined. Furthermore, by using the falling prevention lid 43 as the hitting surface for hammer, the wedge-shaped parts 36 can be more strongly driven into the wedged parts inserting spaces 32 and 33.

Figure 7:
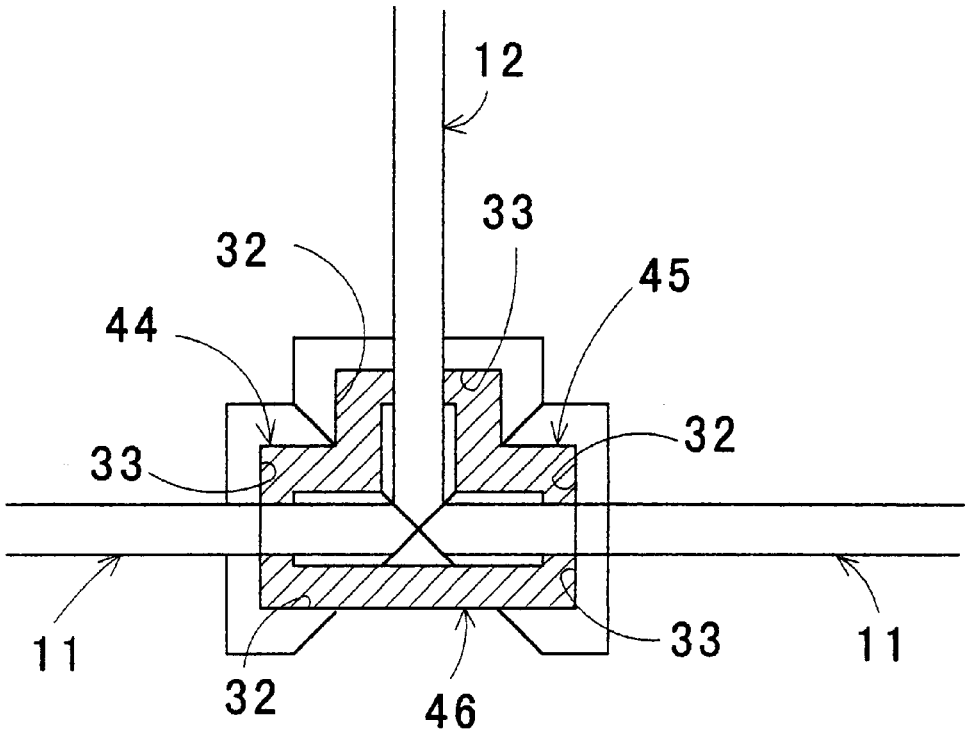
FIG. 7 is a top view of a T joint between frame members joint B of FIG. 1).
Figure 8:
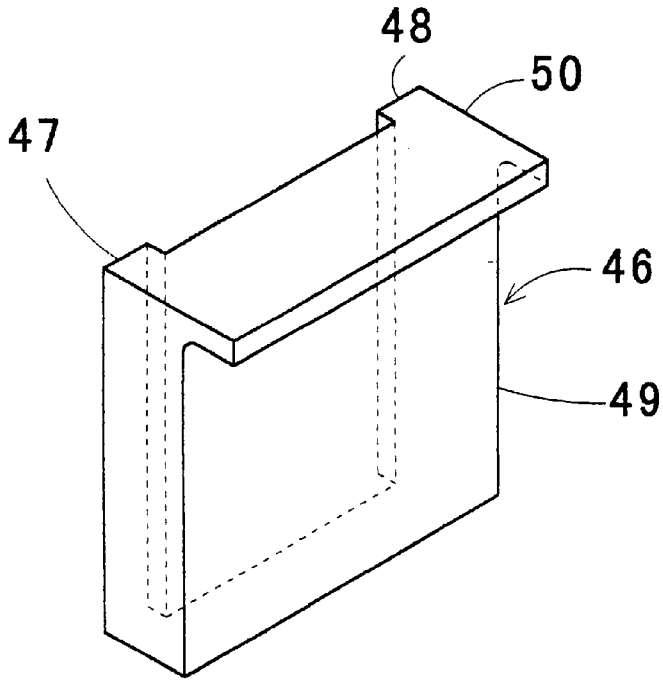
FIG. 8 is a perspective view of a wedge shaped part used in the joint of FIG. 7

As FIG. 1 (the circled area B) and FIG. 7 show, when three plane frames 11 and 12 are joined in a T-shape, three wedge-shaped parts 44, 45 and 46 are used. As the Figures show, wedge-shaped parts 44 and 45 have same construction as wedge-shaped part 36. On the other hand, wedge-shaped part 46, as FIGS. 7 and 8 show, is constructed with the flat board lock 49 which has the lengthwise long catches 47 and 48 at both ends of the surface from the plane level view and the falling prevent lid 50 which is connected to the upper end as one. And the flat board lock 49 is tapering shape and narrowed downwards. By driving three wedge-shaped parts 44, 45 and 46 into the six corresponding hook-shaped wedged parts inserting spaces 32 and 33, three plane frames 11 and 12 can be easily joined very tightly. At this time, by using the falling prevention lid 43 and 50 as the hitting surface for hammer, the wedge-shaped parts 44, 45 and 46 can be more strongly driven into the wedged parts inserting spaces 32 and 33.

Figure 9:
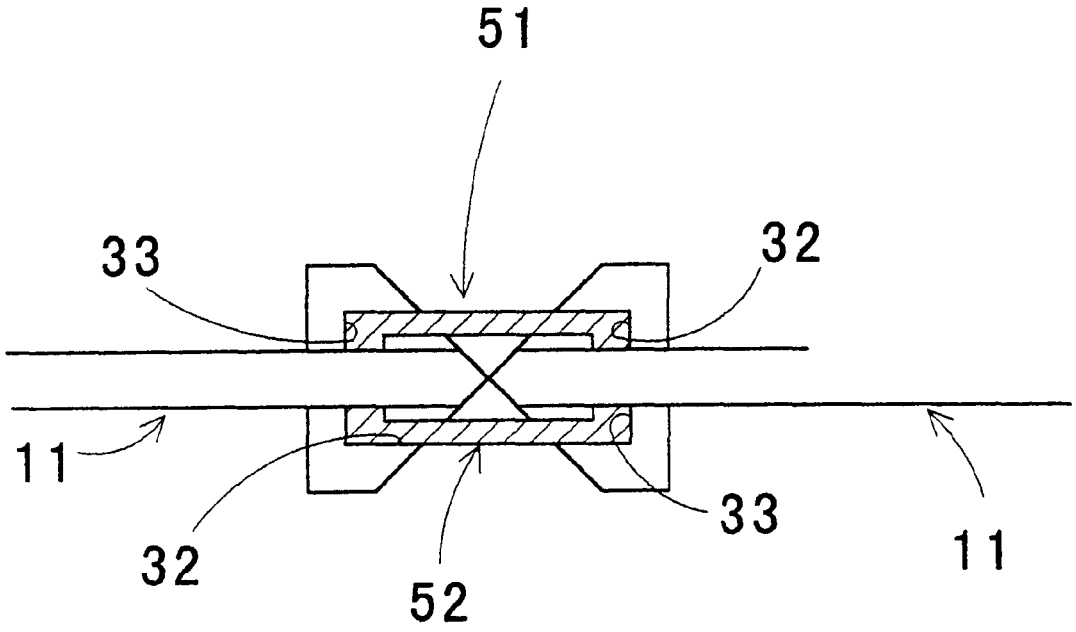
FIG. 9 is a top view of a inline joint between frame members (joint C of FIG. 1).

As FIG. 1 (the circled area C) and FIG. 9 show, when two plane frames 11 are joined straight, two wedge-shaped parts 51 and 52 are used. As the Figures show, the wedge-shaped parts 51 and 52 have same construction as said wedge-shaped part 46. By driving two wedge-shaped parts 51 and 52 into the four corresponding hook-shaped wedged parts inserting spaces 32 and 33, two plane frames 11 can be easily joined very tightly. At this time, by using the falling prevention lid 50 as the hitting surface for hammer, the wedge-shaped parts 51 and 52 can be more strongly driven into the wedged parts inserting spaces 32 and 33.

Figure 10:
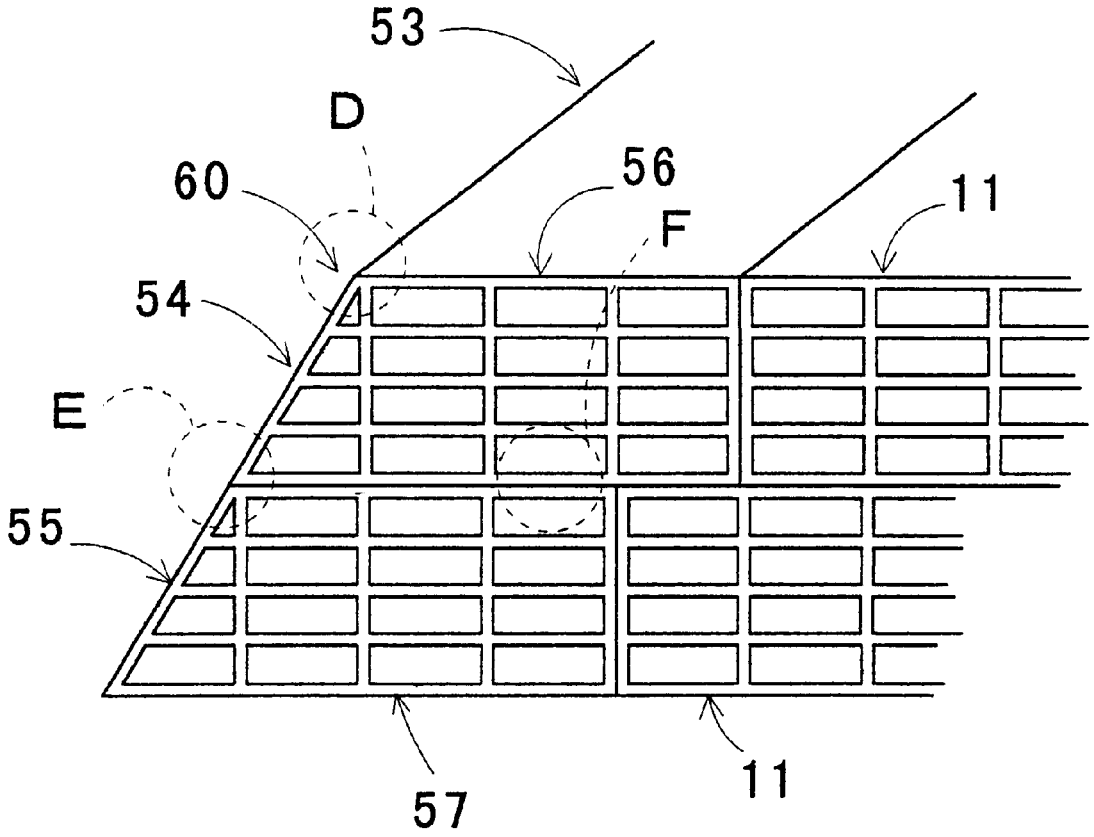
FIG. 10 shows a sloped cage frame of the present invention.

FIG. 10 shows the construction of the cage frame 53 for shore protection and so on related to the example which is changed from the above implementation example. As FIG. 10 shows, the cage frame 53 includes plane frames 56 and 57 with the slant surfaces 54 and 55, and plane frames 11, 56 and 57 are stacked together upward and downward to create the shore protection with the slant surface.

Figure 11:
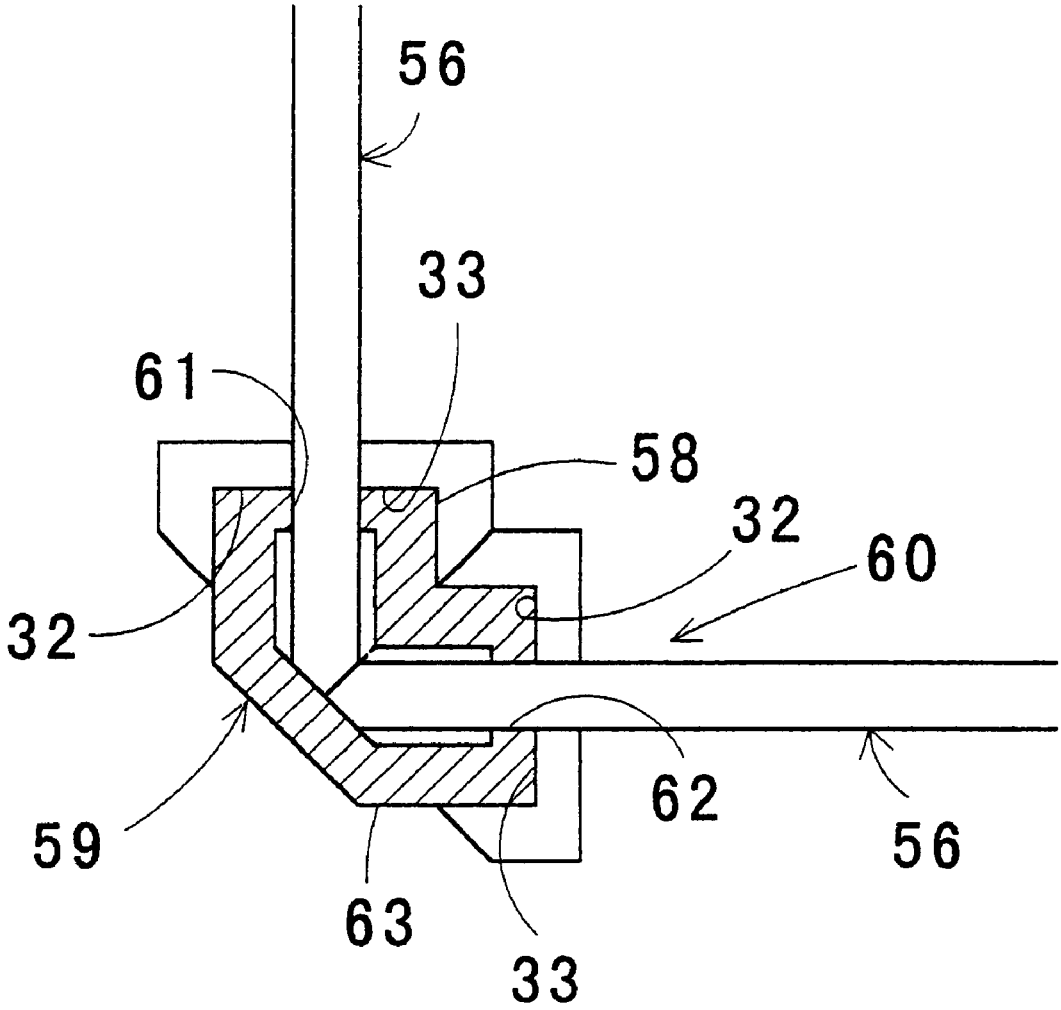
FIG. 11 shows a joint between frame members of joint D of FIG. 10
Figure 12:
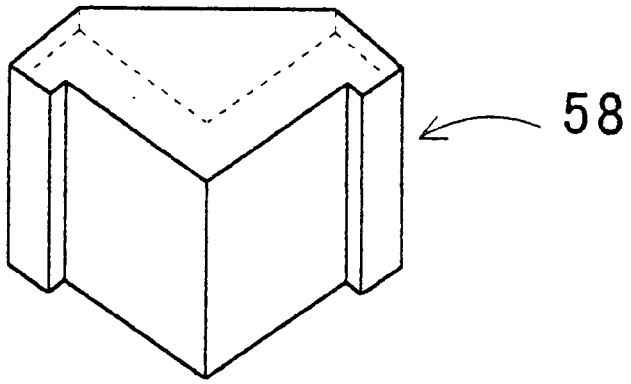
FIG. 12 shows the detail of one wedge shaped part of FIG. 11.
Figure 13:
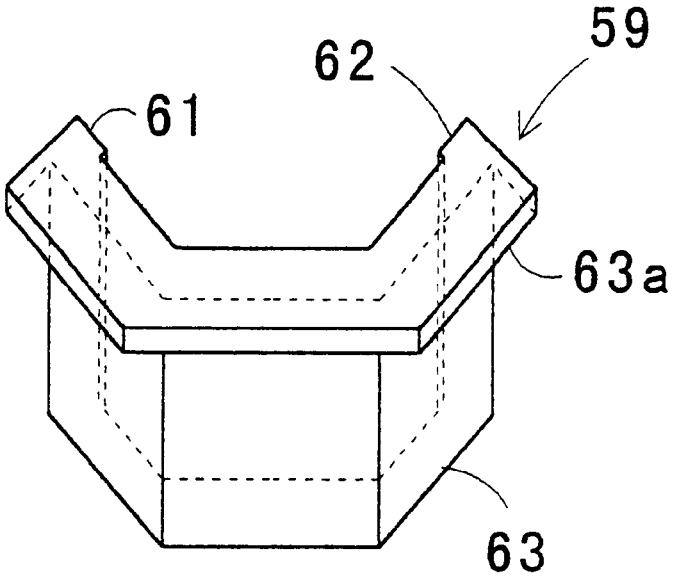
FIG. 13 shows the detail of another wedge shaped part of FIG. 11.

FIGS. 11 and 13 show the joint construction used for joining the top part of the plane frame 56 together and the construction of wedge-shaped parts 58 and 59. And both ends of the plane frame 56 also have the joints 60 which have the same construction of the joints 22~27 of the above plane frames 11 and 12. Here, the wedge-shaped part 58 as FIG. 12 shows has the same construction of wedge-shaped parts 36, 44 and 45. While the wedge-shaped part 59, as FIG. 13 shows, is constructed with the curved lock 63 which has the lengthwise long catches 61 and 62 at the both ends of the surface from the plane level view and the falling prevent lid 63 which is connected on the upper end as one. And the curved lock 63 is tapering shape which narrowed downwards.

As FIG. 10 (the circled area D) and FIG. 11 show, by driving two wedge-shaped parts 58 and 59 into the four corresponding hook-shaped wedged parts inserting spaces 32 and 33, two plane frames 56 can be easily joined very tightly. At this time, by using the falling prevention lid 63*a* as the hitting surface for hammer, the wedge-shaped parts 58 and 59 can be more strongly driven into the wedged parts inserting spaces 32 and 33.

Figure 14:
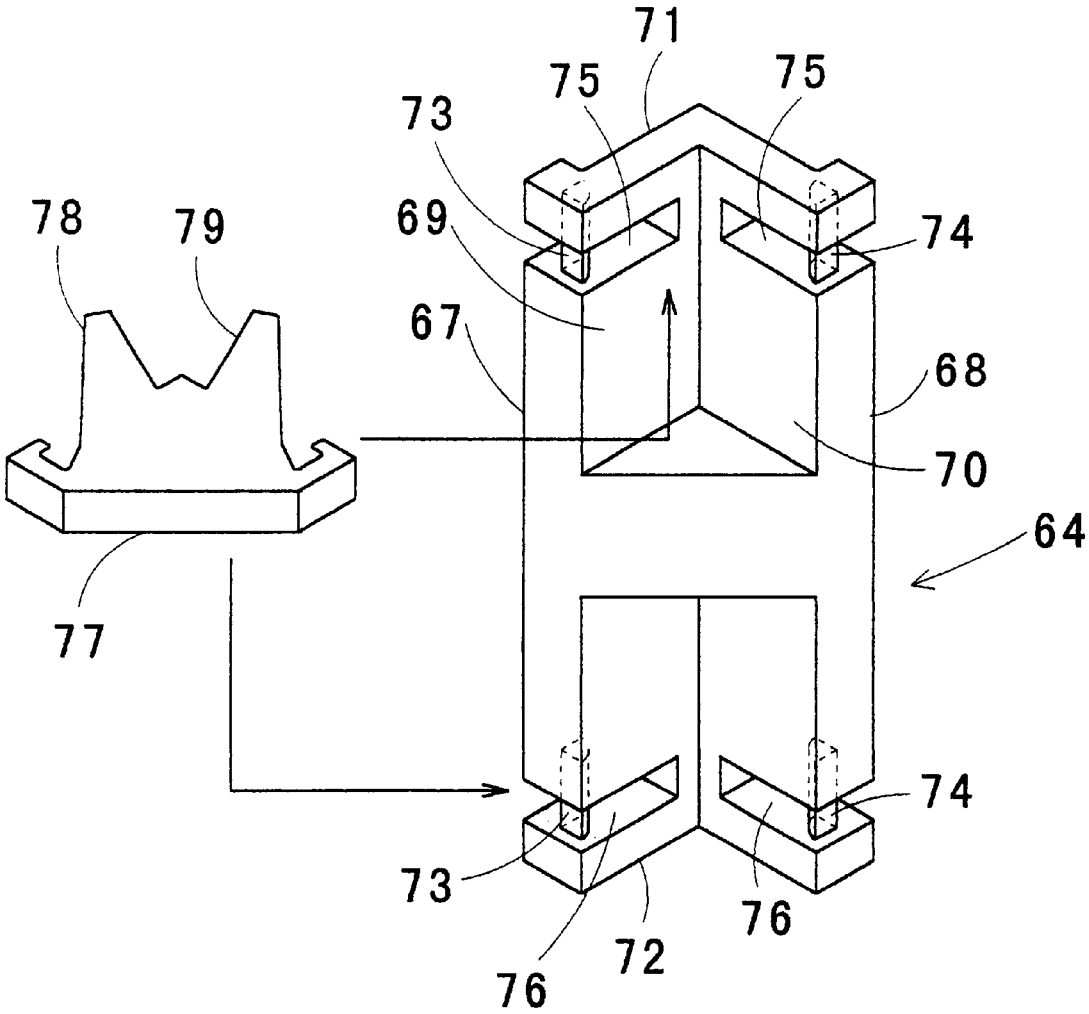
FIG. 14 shows joint parts suitable for joint E of FIG. 10.
Figure 15:
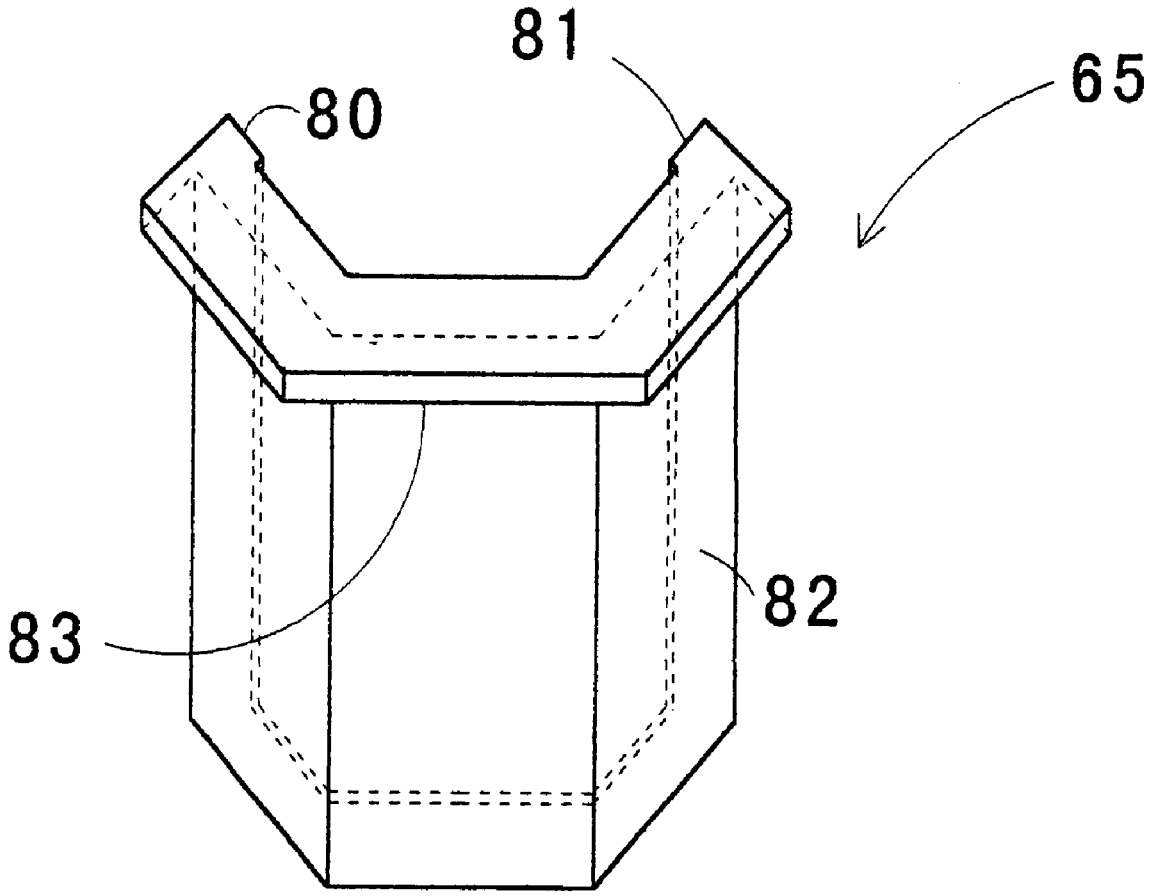
FIG. 15 shows another joint part suitable for joint E of FIG. 10.

The FIGS. 14 and 15 show the joint construction used for joining the bottom part of the plane frame 56 and the upper part of the plane frame 57 together (the circled area E on FIG. 10) and the construction of the wedge-shaped parts 64 and 65. Both ends of plane frame 57 also have the joints which have the same construction of the joints 22~27 of the above plane frames 11 and 12. Here, the wedge-shaped part 64, as FIG. 14 shows, is joined at right angle from the plane level view and constructed with the pair of hook-shaped locks 69 and 70 which have the catches 67 and 68 on the end. And on the upper and bottom end parts of the hock-shaped locks, each of L-shaped lock parts 71 and 72 is spaced and connected with the pins 73 and 74, and each space between the upper and bottom end part and the L-shaped lock parts 71 and 72 forms the lock pin inserting hole 75 and 76. By the locking construction, after inserting into the four corresponding hook-shaped wedged parts inserting spaces 32 and 33, put each lock pin 78 and 79 of two pieces of lock plate 77 through the lock pin inserting hole 75 and 76, and connect to the side of the plane frame 56 and 57, by doing so, the plane frames 56 and 57 can be joined from inside. While the wedge-shaped part 65, as FIG. 15 shows, is constructed with the curved lock 82 which has the lengthwise long catches 80 and 81 at the both ends of the surface from the plane level view and the falling prevent lid 83 which is connected on the upper end as one. And the curved lock 83 is tapering shape and narrowed downwards. By the joint construction, as FIG. 10 (the circle area E) shows, by driving into the four corresponding hook-shaped wedged parts inserting spaces 32 and 33, two plane frames 56 and 57 can be easily joined very tightly from outside. At this time, by using the falling prevention lid 83 as the hitting surface for hammer, the wedge-shaped part 65 can be more strongly driven into the wedged parts inserting spaces 32 and 33.

Figure 16:
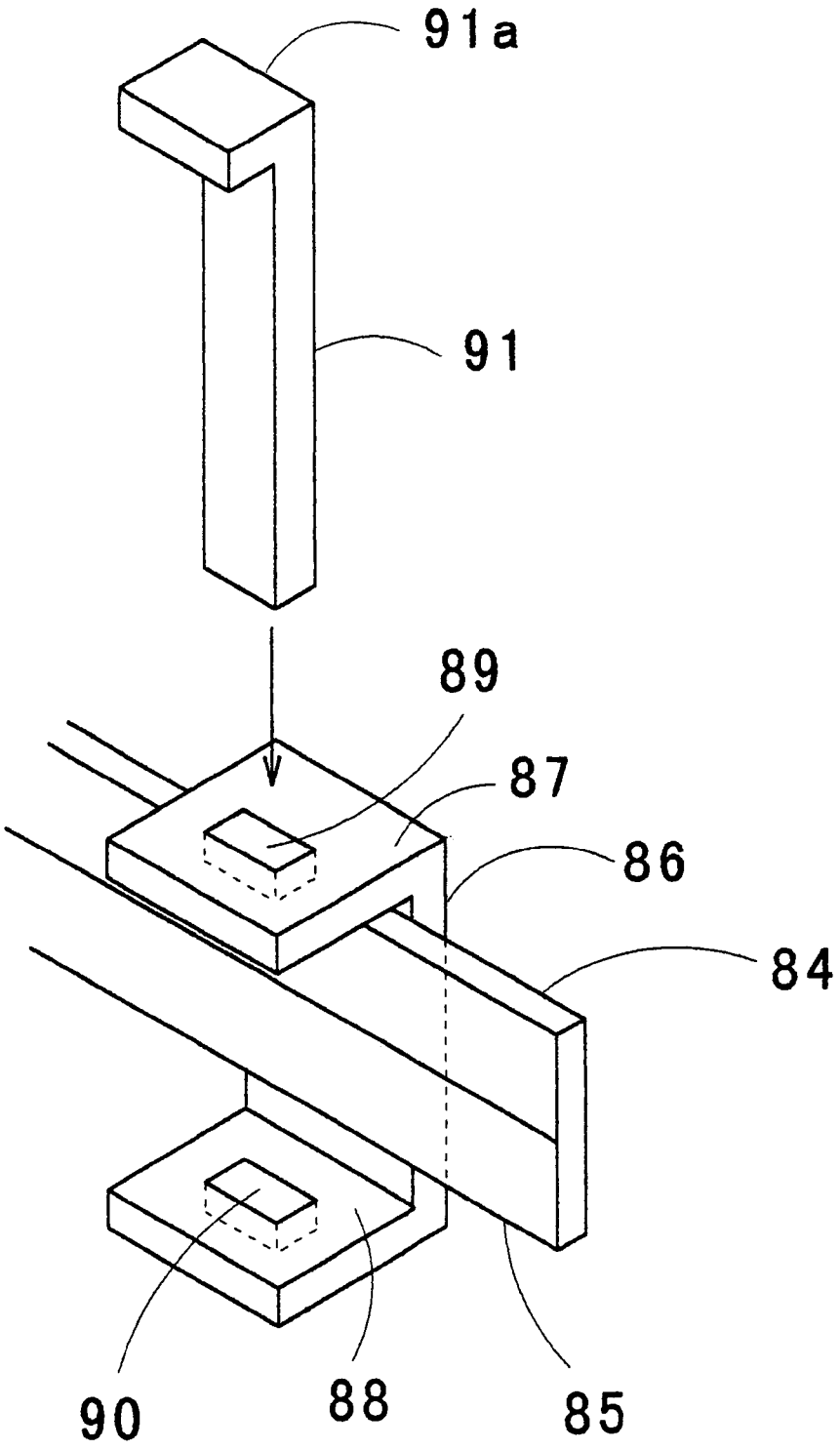
FIG. 16 shows details of joint F of FIG. 10.

FIG. 16 shows the joint construction of top and bottom stacking of the plane frames 56 and 57 (or both plane frames 11) and joining of the parallel extending area (the circled area F on FIG. 10). As FIGS. 10 and 16 show, the rectangle frames 84 and 85 of plane frames 56 and 57 are inserted into the U-shaped from the side view channeling material 86. And each tip of the upper and lower flange areas 87 and 88 of channeling material 86 has wedge-shaped part fitting hole 89 and 90. By going through these wedge-shaped part fitting hole 89 and 90 and driving the wedge-shaped part 91 which has the falling prevention lid 91*a* on the top, the rectangle frames 84 and 85 of plane frames 56 and 57 can be joined.

Figure 17:
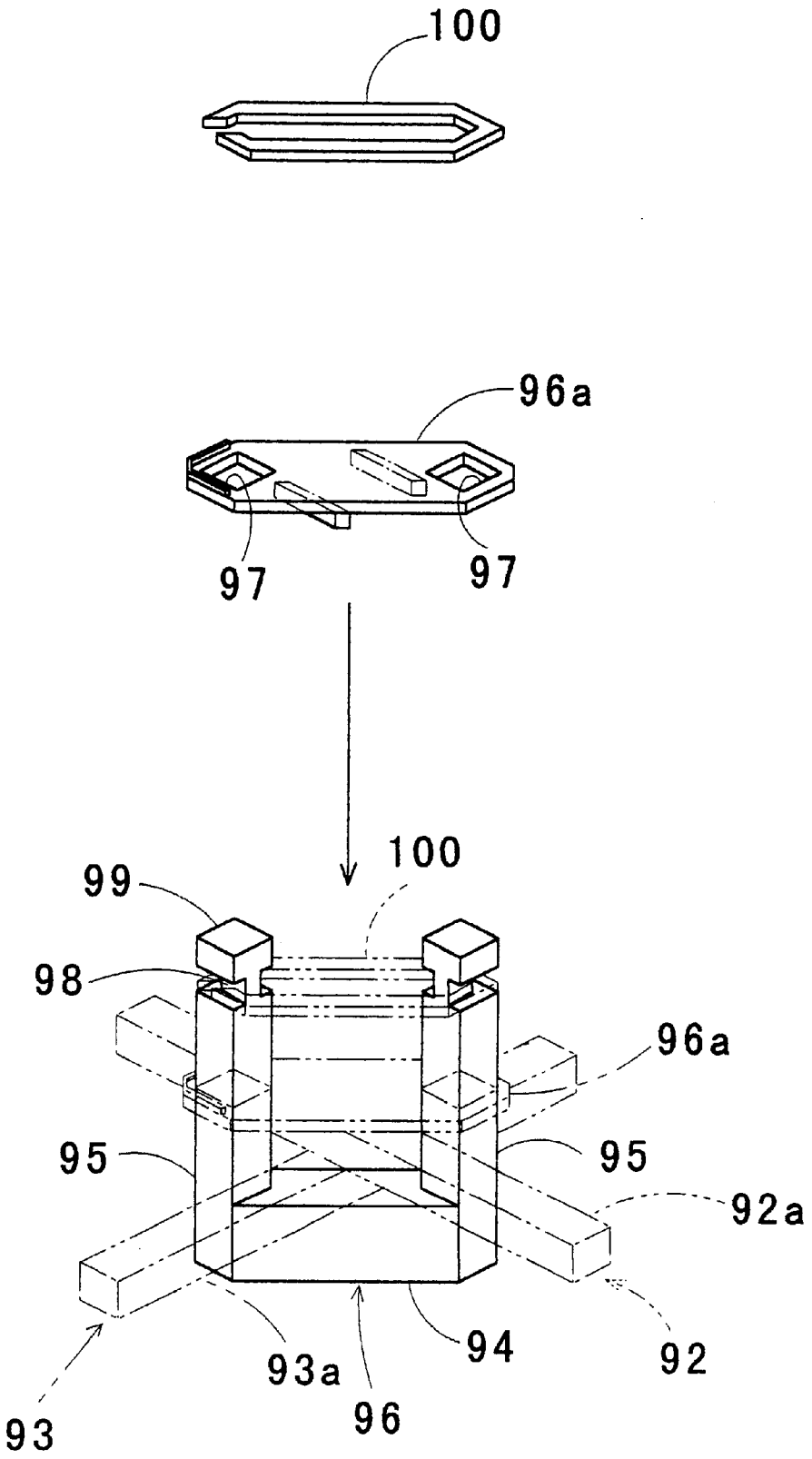
FIG. 17 shows a joint between plane frames of the cage frame.

FIG. 17 shows, the joint construction which can join the bottom side of the plane frame 92 and the upper side of the plane frame 93 which are connected and crossed. As FIG. 17 shows, the joint construction which can join the bottom side of the plane frame 92 and the upper side of the plane frame 93 which are connected and crossed. As shown, the main framings 92*a* and 93*a* of the plane frames 92 and 93 are placed crosswise within the U-shaped support part 96 which connected the pair of vertical parts 95 to the both ends of the bottom leveled are 94. And on the vertical part 95, the fitting hole 97 on the both ends of the press board 96*a* is fitted. Also on the upper end of the vertical part 95, the vertical part 95 and the same style head part 99 are connected with the small diameter part 98. And by fitting the both ends of the U-shaped anti-falling pin 100 on the small diameter part 98, the main framing 92*a* and 93*a* of the plane frame 92 and 93 which are connected crosswise can be easily joined tightly.

Figure 18:
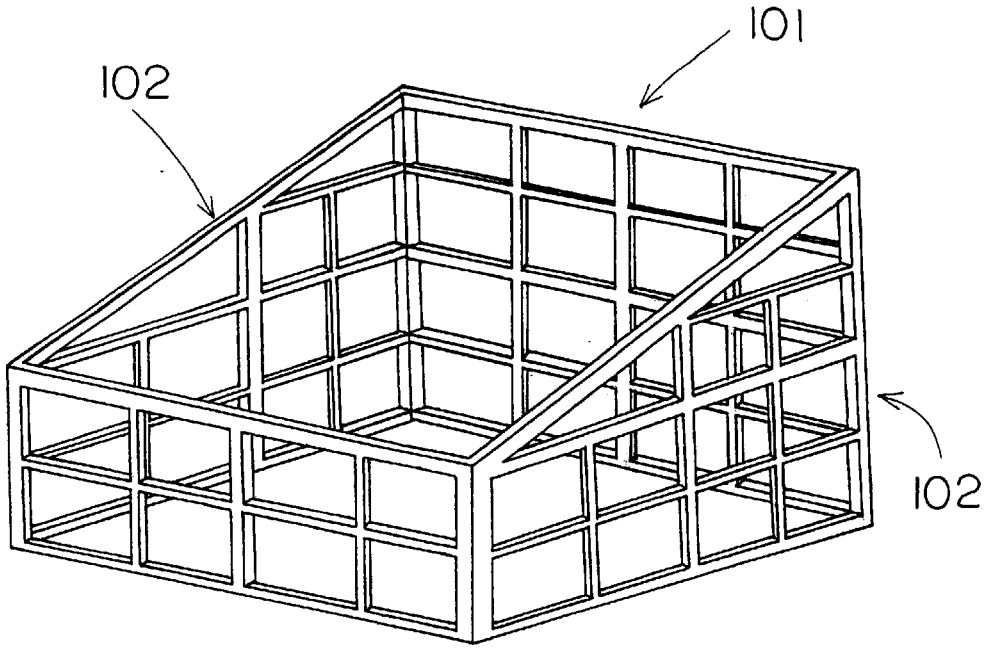
FIG. 18 shows an alternate embodiment of the cage frame of the present invention.
Figure 19:
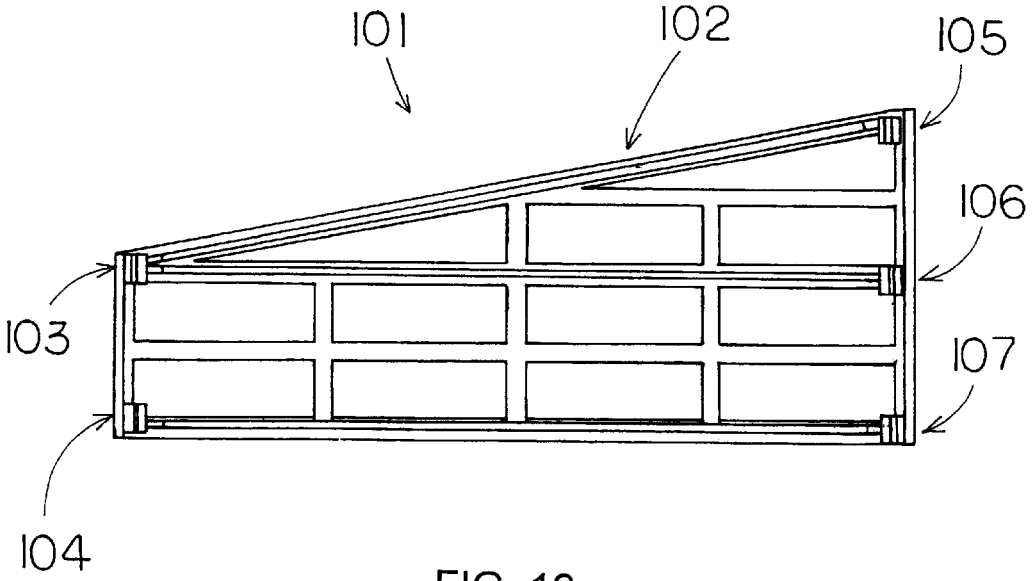
FIG. 19 shows a front view of the side panel of FIG. 18.
Figure 20:
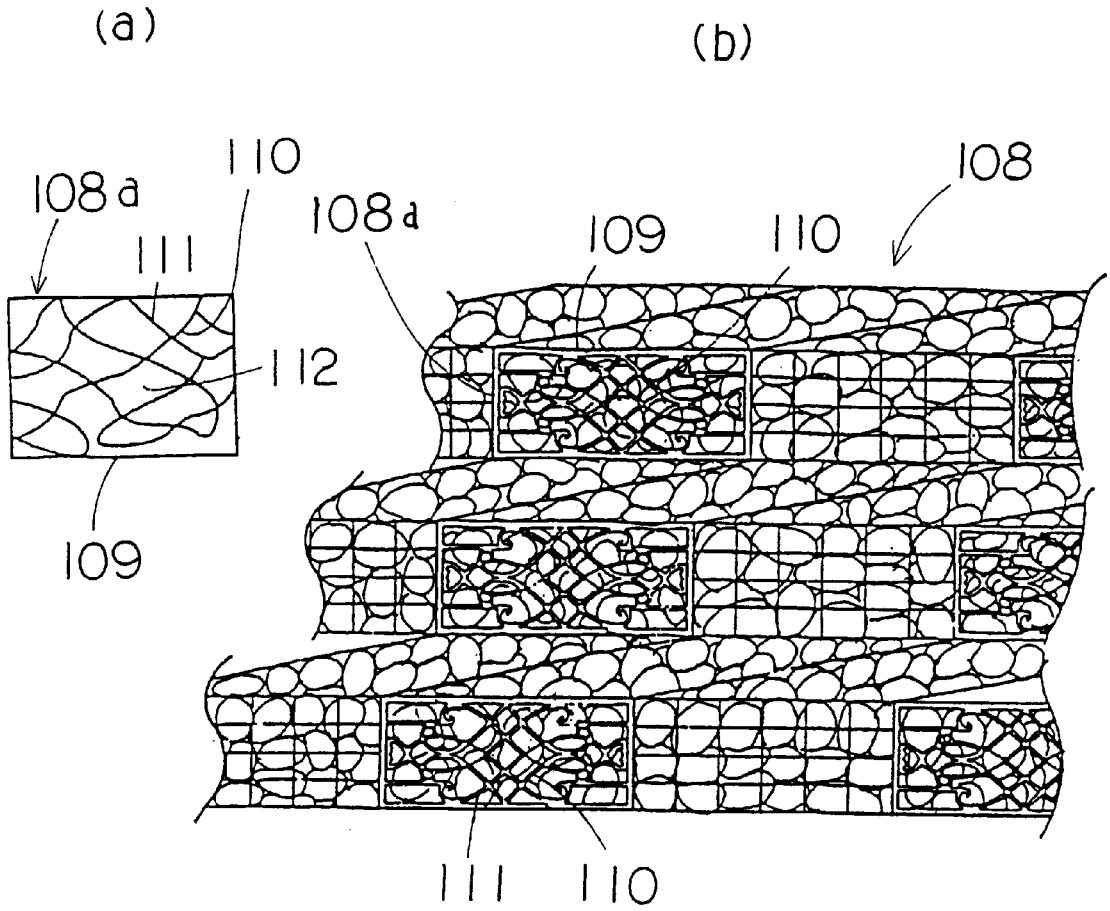
FIG. 20*a* shows a alternate arrangement of the cross members on a frame member
FIG. 20*b* shows a representation of the frame member of FIG. 20*a* being used to form a cage frame of the present invention with rocks added.

FIGS. 18 and 19 show the construction of the cage frame 101 for shore protection and so on related to the example changed from this implementation examples which are explained and referred to FIGS. 1~9. As the Figures show, cage frame 101 has characteristics of using the big plane frame 102 which the surface is gradually getting higher from the front or back from the side view. These plane frames 102 also form joints 103~107 on the front and back sides. FIG. 20 shows the construction of the cage frame 108 for shore protection and so on related to the example changed from this implementation examples which are explained and referred to FIGS. 1~9. As FIG. 20(*a*) shows, the plane frame 108*a* of the cage frame 108 forms the diamond shaped opening 112 by constructing the vertical cross piece 110 and the horizontal cross piece 111 obliquely within the main framing 109. By forming the diamond shaped opening 112 like this, more ornamental effect can be increased than the plane frames 11 and 12 which form the rectangle spaces (refer to FIG. 1). And FIG. 20(*b*) shows the condition which the low-water shore protection is formed by the cage frame for shore protection and so on 108 constructed on the FIG. 20(*a*).

By this construction, the time of the execution, the outside appearance is beautiful, and after few years from the execution, the sense of natural metal color of cast iron matches the natural environment, and by iron ion generation from the cast iron and effective mineral water formation, the water quality environment can be improved, and the great living environment for fish can be created because the density of filled broken stones and so on filled within the framing, that is, the open space is existed, and the opening 112 is existed. And for the surface, greenery construction can be performed.

Figure 21:
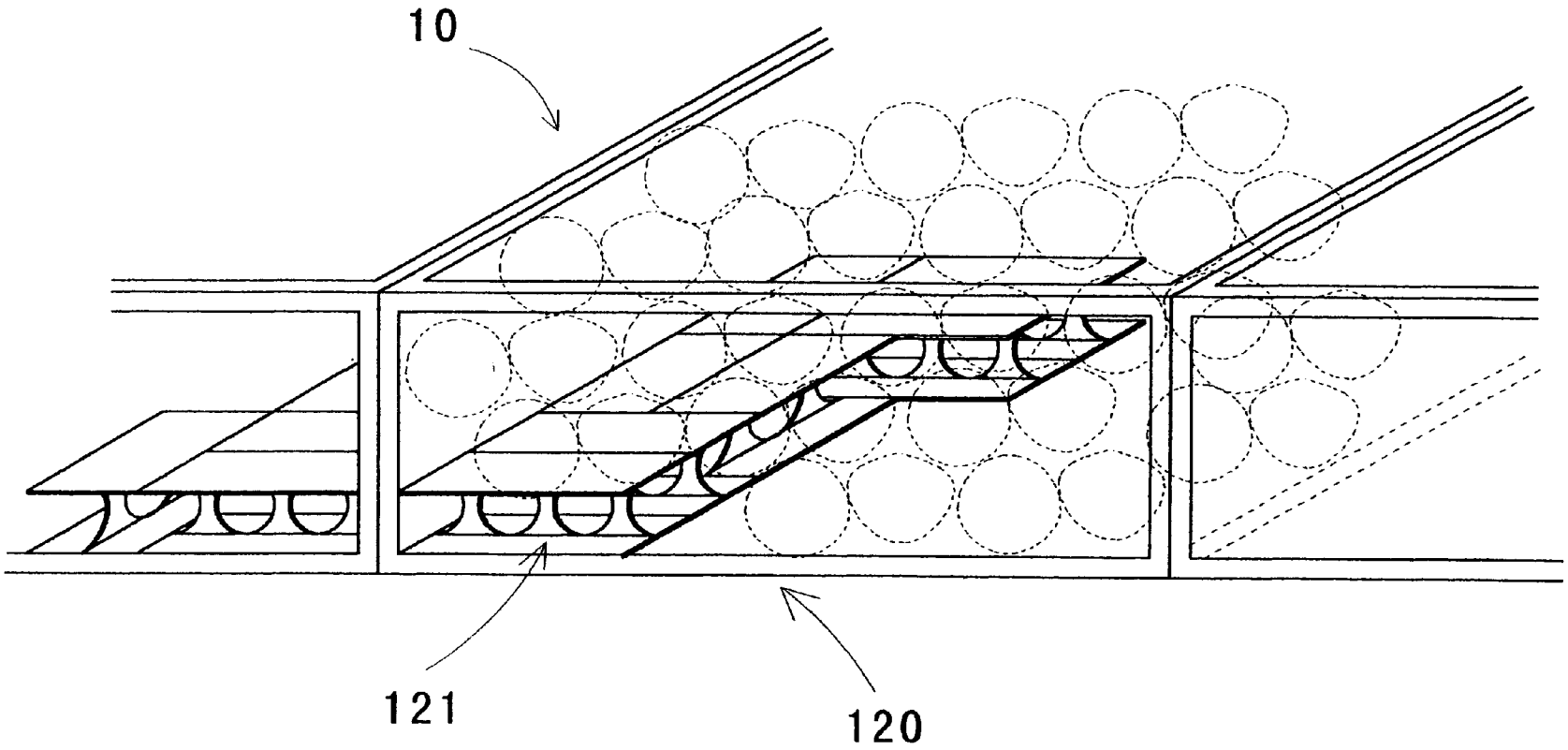
FIG. 21 is a simplified representation of cage frame having additional structures added to form hidden channels for fish gathering places.
Figure 22:
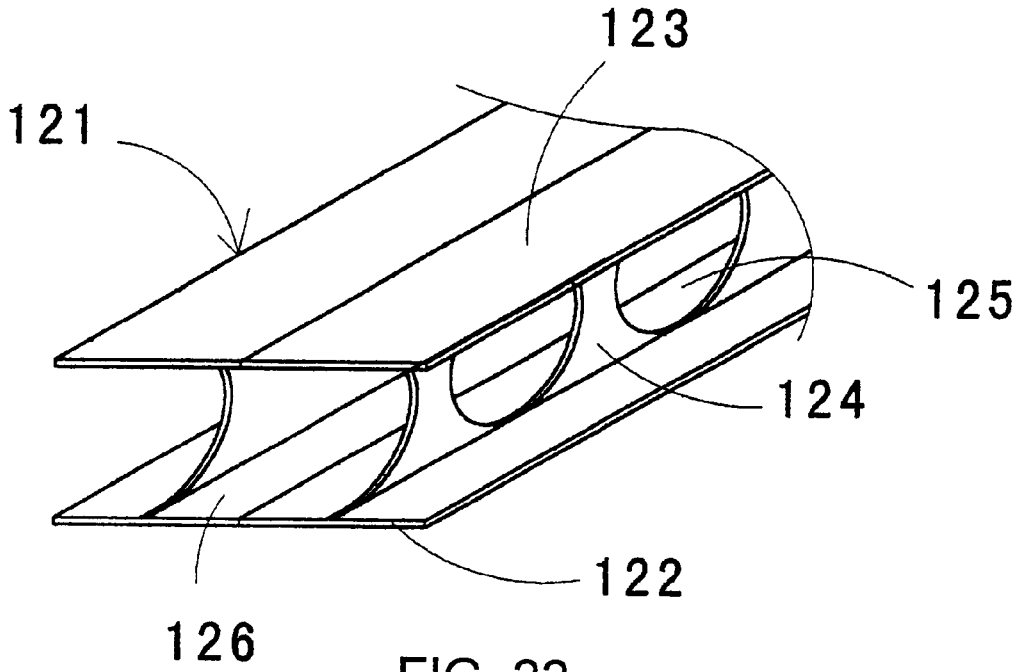
FIG. 22 shows the detail of one possible channel structure for use in FIG. 21.
Figure 23:
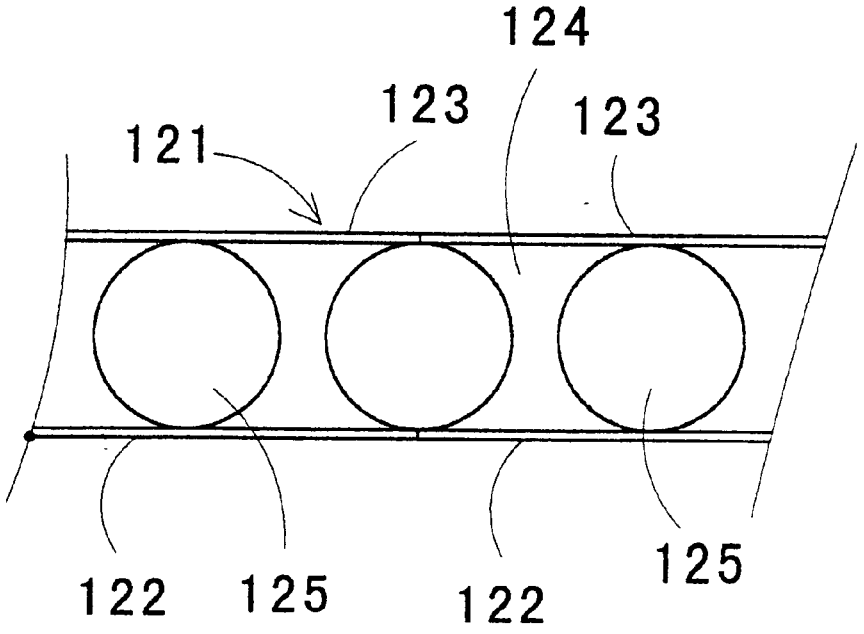
FIG. 23 shows additional detail of the channel structure of FIG. 22.

FIG. 21 shows when the channel forming block 120 is formed on the bottom of the cage frame 100 to create a gathering place for fish. That is, on the bottom of the cage frame 10, many channel forming blocks 121 are placed, and these channel forming blocks 121 are made of cast iron as the plane frames 11 and 12. As FIGS. 21~23 show, the channel forming blocks 121 are constructed by joining the center of the bottom board formed by the long rectangle board and the top board 123 together by the long length joining board 124 which has the fixed height and expands in the direction of the stretcher. And on the long length joining board, the connection holes 125 are formed leaving space in the direction of the stretcher.

Therefore, as FIG. 21 shows, when the channel forming blocks 121 are lined on the bottom of the cage frame for shore protection and so on 10, the vertical long waterway 126 which fish and so on pass through can be formed between the long length joining board 124. Moreover, the vertical long waterways 126 can be connected and passed through together by the connection hole 125 which is opened at the right angle to the axis of the vertical long waterway 126.

Therefore, water can spread to the deep part of the channel forming blocks 120, the propagation of bacteria or alga on the surface of the channel forming block 121 is accreted, and fish and so on can be migrated freely.

The present invention has been described above with reference to some preferred embodiments; however, the invention is not limited to these embodiments. Instead, the present invention may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein. In this connection, nothing is explained on the above about the bottom part (bottom frame) and the lid part (ceiling frame) of the hollow framing constructed by joining many plane frames, but of course, the bottom part with many openings, each or both lid parts can be set and used as the plane frames which form the side wall (side frame). And said bottom part and lid part made of cast iron are used as the plane frame.

As it is clear by the above explanations, because the plane frame is made of cast iron, the strength of the cage frame 10 can be very much improved, the frame will not be deformed by receiving big force of water from flood and so on, or by being filled with broken stones, stones and so on, and can certainly prevent broken stones and stones from flowing out. Furthermore, because the joints of plane frame are joined together with the joint part, by only inserting the plane frame and so on, the hollow framing can be easily structured/formed, and because it can join very tightly, the hollow framing can keep. enough structural strength.

Because each plane frame is made of cast iron, it is easy to connect the joints with the appropriate shape which can improve the joint strength by working with the joint parts and the main framing as one. From this side, the strength of joining the plane frames together can be improved.

Because each plane frame is made of cast iron, when it is placed for shore protection and so on, iron, calcareous and magnesium in the cast iron are liquidated into water, it helps plant plankton to increase which are increased by carbonic acid gas, light and water, and activates the rearing of fish, shellfish and seaweed. And water contains iron, the living compound of photosynthetic pigment and respiration of cells can be performed smoothly. That is, it is the best environment for the various organisms including plants and fish to live, what is called biotope can be easily created. Furthermore, the space created between broken stones and so on can be used as a living space, a hiding place or a shelter, and it can be used effectively as a gathering place for fish.

Because each plane frame is made of iron, the corrosion protective covering is created by reaction between carbon and other contained metal constituents, and it is resistant to seasons. It has enough corrosion resistance even within water, and can be used for long time.

Because each plane frame is made of cast iron, the same shape type of plane frame can be mass-produced by one cast type and the unit price of plane frame can be decreased.

When the wedge-shaped part is used as a joining part, the joints can be joined tightly together by the joint part. Therefore, the joint strength of panel frames can be improved. By making the joint part of cast iron as the plane frame, erosion can be prevented by electric reaction, and bacteria which like carbon attach on the surface of wedge part, from the side, biotope can be easily created. Further, because the same shaped joints are set on many plane frames as one, and the different shaped joint parts can be used depending on the joining condition of both joints, most appropriate cage frame for shore protection and so on can be executed following the shape of the shore of river or ocean which is wanted to protect.

Additionally, by forming the joints which can be easily and certainly fitted and joined with the joint parts, the plane frames can easily be joined together straight, angled or crosswise and also joined vertically.

What is claimed is:

1. An assembly for retaining rocks, comprising:

a plurality of interconnected generally planar frame members, said frame members formed from cast iron in a unitary fashion and having an upper rail, a lower rail, at least one cross-member disposed between said upper rail and said lower rail, and end joint sections;

a plurality of fill spaces defined by said frame members for retaining rocks;

wherein each joint section of said frame members defining said fill spaced is joined to at least one other joint section of another frame member; and wherein said joint sections include a pointed central tine aligned coplanar with said upper rail, first and second outer tines extending parallel to said central tine and equally disposed on opposite sides thereof, and an embossment on said central tine opposite each of said outer tines, each of said outer tines forming a hook shaped cavity with said central tine and the corresponding embossment.

2. The assembly of claim 1 wherein said central tine is longer than said outer tines.

3. The assembly of claim 2 wherein said outer tines include an outwardly slanted endface.

4. The assembly of claim 3 wherein said central tine includes a first and second slanted face forming a central pointed edge and wherein said slanted endface of said first outer tine is coplanar with said first slanted face and said slanted endface of said second outer tine is coplanar with said second slanted face.

5. The assembly of claim 1 further including a plurality of cast iron wedge pieces and wherein said joint sections are joined by filling two or more of said hook shaped cavities with said wedge pieces.

6. An assembly for retaining rocks, comprising:

a) a plurality of interconnected generally planar frame members, said frame members formed from cast iron in a unitary fashion and having an upper rail, a lower rail, at least one cross-member disposed between said upper rail and said lower rail, and means for joining said frame member to at least two other frame members;

b) a plurality of fill spaces defined by said frame members for retaining rocks, c) wherein each joint section of said frame members defining said fill spaced is joined to at least one other joint section of another frame member via said joint means.

7. An assembly for retaining rocks, comprising:

a plurality of interconnected generally planar frame members, said frame members having an upper rail, a lower rail, and integral end joint sections, said joint sections comprising a pointed central tine aligned coplanar with said upper rail, first and second outer tines extending parallel to said central tine and disposed on opposite sides thereof;

a plurality of fill spaces defined by said frame members for retaining rocks; and wherein each joint section of said frame members defining said fill spaced is joined to at least one other joint section of another frame member.

8. The assembly of claim 7 wherein said upper rail has a longitudinal axis and wherein said frame members further comprise at least one integral cross-member disposed generally parallel to said longitudinal axis.

9. The assembly of claim 7 wherein said outer tines include an outwardly slanted endface.

10. The assembly of claim 9 wherein said central tine includes first and second slanted faces forming a central pointed edge and wherein said slanted endface of said first outer tine is coplanar with said first slanted face and said slanted endface of said second outer tine is coplanar with said second slanted face.

11. An assembly for retaining rocks, comprising:

a plurality of interconnected generally planar frame members, said frame members formed from cast iron in a unitary fashion and having an upper rail, a lower rail, at least one cross-member disposed between said upper rail and said lower rail, and end joint sections;

a plurality of fill spaces defined by said frame members for retaining rocks;

a plurality of joint members, each joint member in wedged engagement with corresponding end joint sections of at least two different frame members so as to form a joint therebetween, each of said joint members being generally tapered in a first direction and comprising first and second catch portions disposed proximate respective ends of said joint member and protruding generally perpendicular to said first direction, said first and second catch portions engaging respective end joint sections of different frame members; and wherein each end joint section of said frame members defining said fill spaced is joined to at least one other joint section of another frame member.

12. The assembly of claim 11 wherein each of said frame members includes at least one straight cross-member running generally parallel to said upper rail.

13. The assembly of claim 11 wherein each of said first and second catch portions of said joint members engage respective end joint sections of different frame members by abutting thereagainst.

14. The assembly of claim 11 wherein said joint sections comprise cast iron.

* * * * *